United States Patent [19]

Sells

[11] Patent Number: 5,054,254

[45] Date of Patent: Oct. 8, 1991

[54] CORRUGATED ROOF VENT WITH END CAP AND METHOD OF MAKING SAME

[75] Inventor: Gary Sells, Mishawaka, Ind.

[73] Assignee: Cor-A-Vent, Inc., Mishawaka, Ind.

[21] Appl. No.: 624,185

[22] Filed: Dec. 7, 1990

[51] Int. Cl.[5] ..... E04D 13/16

[52] U.S. Cl. ..... 52/199; 52/801; 52/747

[58] Field of Search ..... 52/199, 795, 796, 801, 52/198, 105, 747

[56] References Cited

U.S. PATENT DOCUMENTS

| | | | |
|---|---|---|---|
| 3,598,688 | 8/1971 | Bellamy | 52/199 |
| 4,484,424 | 11/1984 | Logsdon | 52/199 |
| 4,567,084 | 1/1986 | Juei Jse | 52/795 |

*Primary Examiner*—Richard E. Chilcot, Jr.
*Assistant Examiner*—Joanne C. Downs
*Attorney, Agent, or Firm*—James D. Hall

[57] ABSTRACT

An end cap for a ridge of a roof formed from a corrugated ridge vent. A longitudinal strip is removed from each of the lower corrugated layers adjacent a side edge to create a flap from the extending portion of the upper sheet of corrugated material. The flap is then folded over the side edges of the lower corrugated layers to provide an end cap from the ridge of a roof.

5 Claims, 2 Drawing Sheets

CORRUGATED ROOF VENT WITH END CAP AND METHOD OF MAKING SAME

FIELD OF THE INVENTION

This invention relates to a corrugated roof vent and has specific relevance to a corrugated roof vent with an end cap and to the method of making same.

BACKGROUND OF THE INVENTION

Ventilated roof caps formed from a corrugated material are known in the industry. Examples of such corrugated plastic roof caps are illustrated in U.S. Pat. Nos. 3,949,657 and 4,803,813. A problem associated with the prior art corrugated roof caps is that the corrugated end wall of the cap is exposed which allows the entrance of moisture and insects.

SUMMARY OF THE INVENTION

The ventilated roof vent of this invention eliminates the problem described above by providing a corrugated roof vent having an end cap over the end wall to restrict the entrance of moisture and insects. The lower layers of a known corrugated roof vent are removed adjacent the end edge of the vent. The remaining end flap is bent over the edge and secured by tape or bent completely under the roof vent and secured by nailing. Folding the end flap over the end of a roof vent creates an end cap over the corrugated end wall of the cap.

Accordingly, it is an object of this invention to provide for a novel roof vent having an end cap.

Another object of the invention is to provide for an economical method of making a corrugated roof vent having an end cap.

Other objects of the invention will become apparent on a reading of the following description taken with the accompanying description.

DESCRIPTION OF THE PREFERRED EMBODIMENT

The preferred embodiments herein described are not intended to be exhaustive or to limit the application to the precise forms disclosed. Rather they are chosen and described so that others skilled in the art might utilize their teachings.

Figure 1:
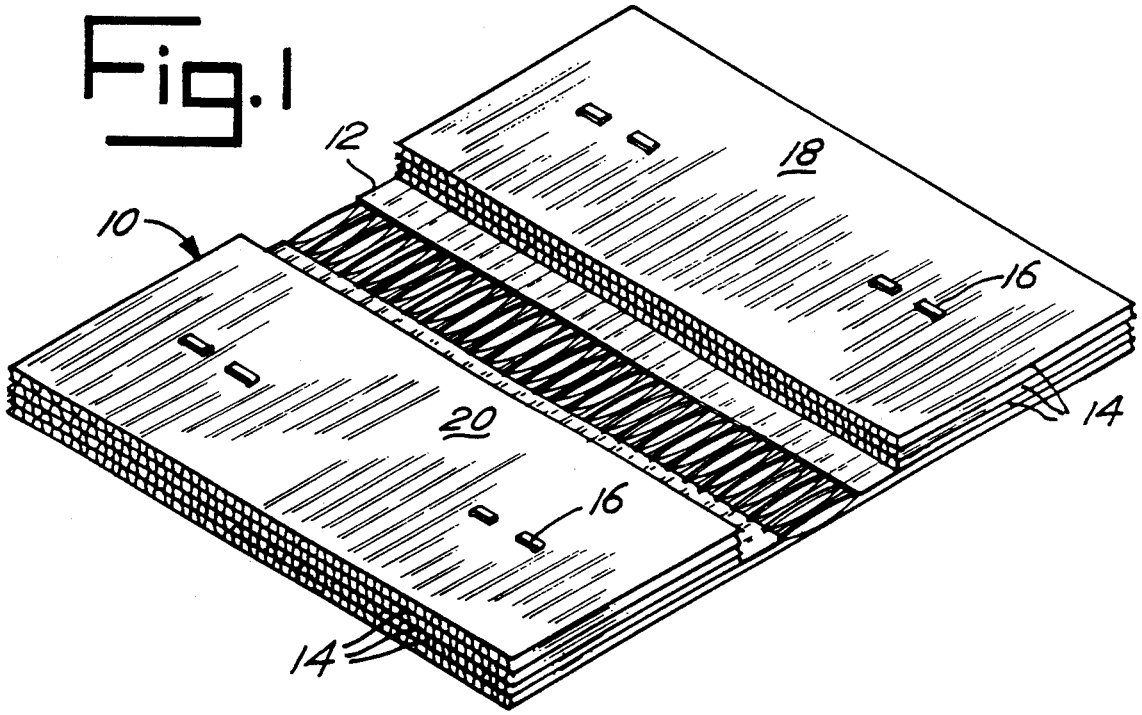
FIG. 1 is a perspective bottom view of a known corrugated vent cap.
Figure 2:
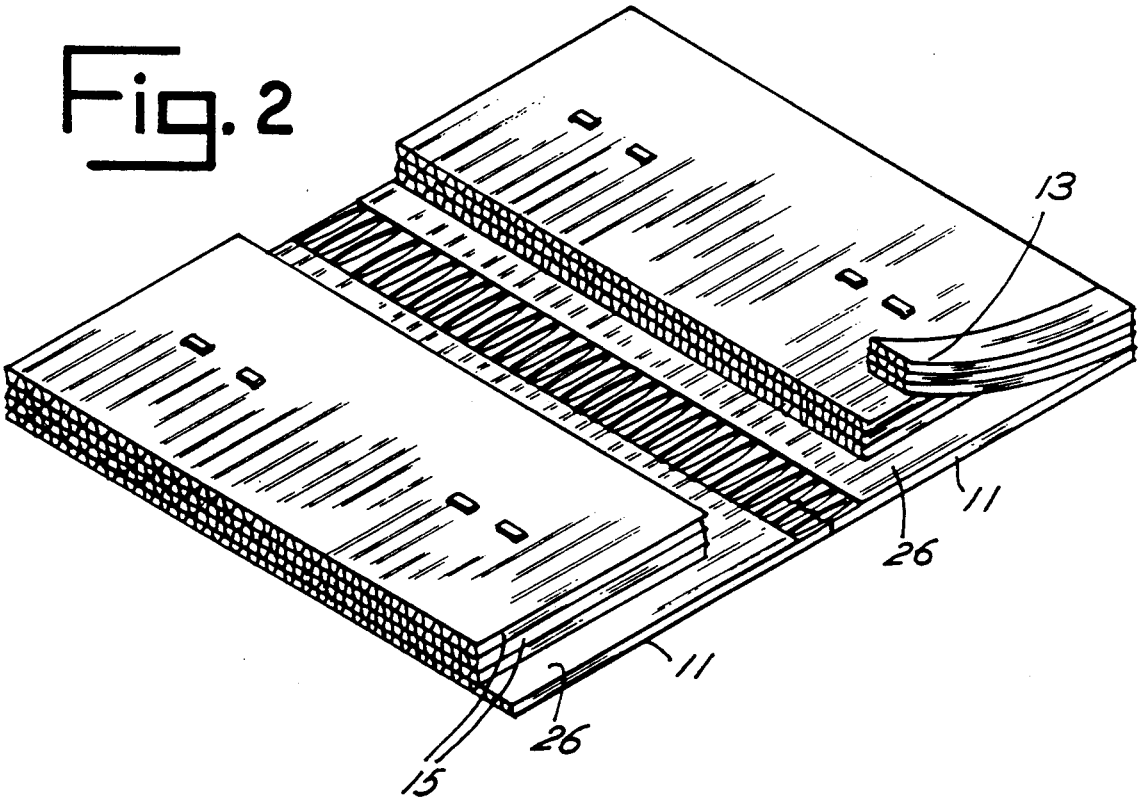
FIG. 2 is the perspective view of FIG. 1 with portions of the lower corrugated layers removed or being removed in the process of making the end cap of this invention.
Figure 3:
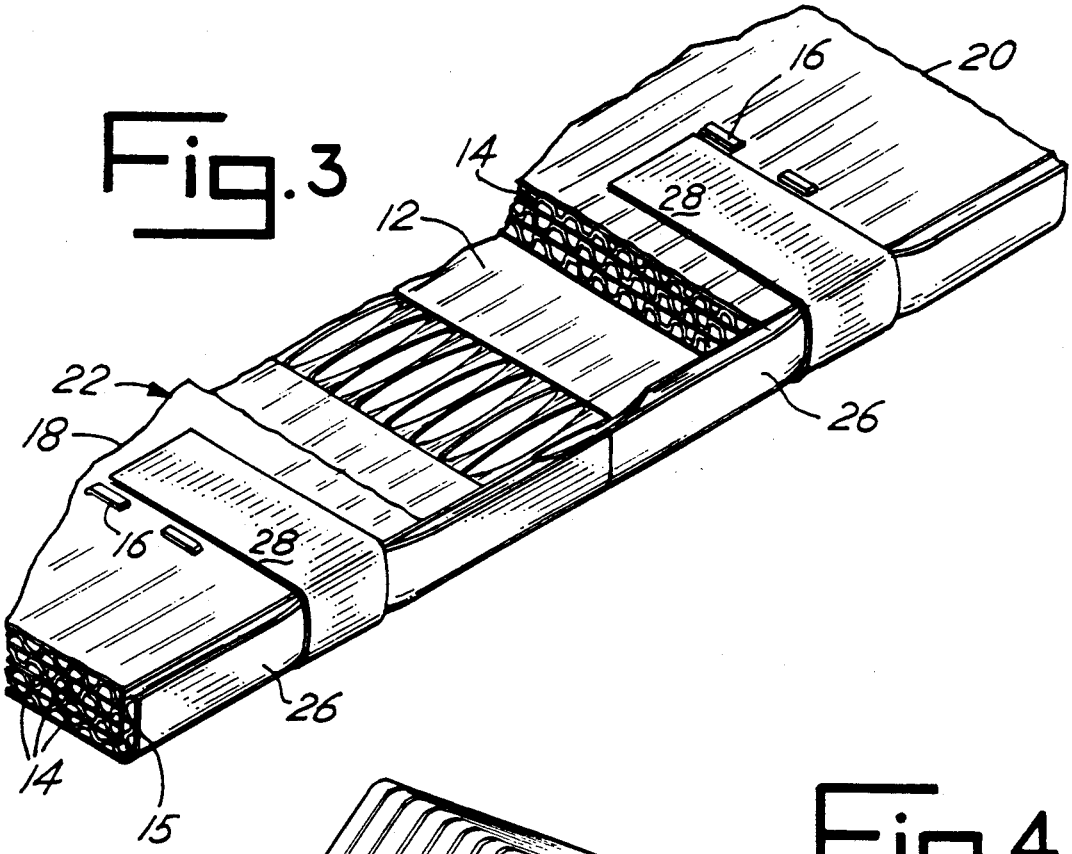
FIG. 3 is a bottom perspective view of a roof vent and end cap of this invention.

As illustrated in the figures, a corrugated roof vent 10 of a type known in the industry, is shown and includes a single corrugated sheet 12. A plurality of corrugated sheets 14 are stacked on sheet 12 and connected to the sheet by adhesive glue or a mechanical fastener such as a staple 16. The corrugated sheets are connected to sheet 12 so as to form right and left halves 18 and 20 and are spaced as illustrated. It should be understood that the corrugated roof cap 10 illustrated in FIGS. 1-3 is shown upside-down for illustrative purposes.

Figure 4:
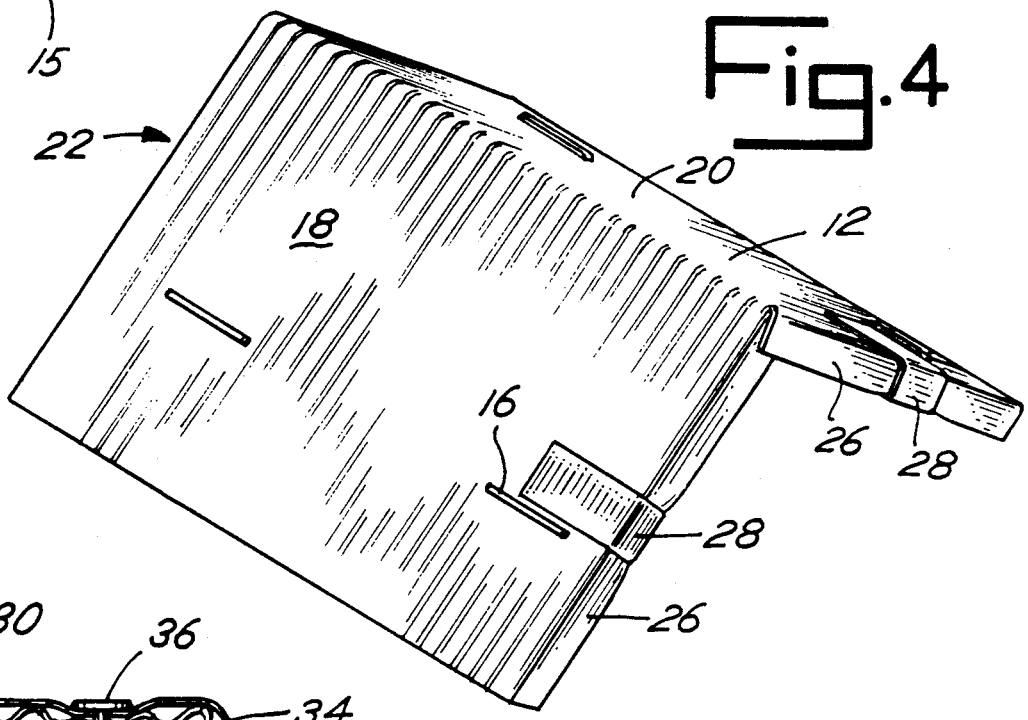
FIG. 4 is a perspective view of the invention in its environment.

To construct the corrugated roof vent with an end cap 22 of this invention illustrated in FIG. 4, a strip 13 of each layer 14 is removed so that side edge 11 of sheet 12 extends beyond the side edges 15 of layers 14 and constitutes a flap 26. Flap 26 is cut at a central location relative to right and left halves 18 and 20 as illustrated in the figures. After the strips from sheets 14 are removed, each flap 26 is folded against the side edges 15 of sheets 14 and secured from movement by strips of adhesive tape 28. FIG. 4 illustrates the end cap of this invention folded appropriately for connection to the ridge of a roof structure (not shown). As illustrated, flap 26 closes the side edges 15 of the corrugated layers 14 (see FIGS. 2 and 3). The corrugated roof vent with an end cap 10 may be nailed to the roof structure as common and then covered by shingles.

Figure 5:
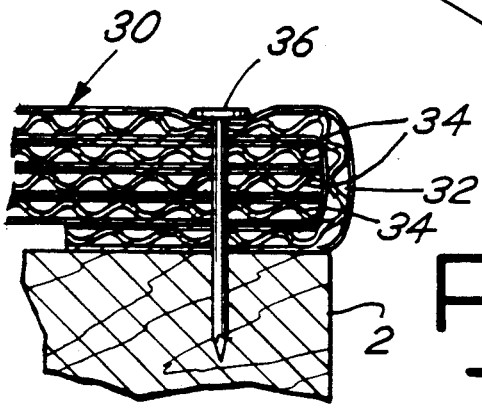
FIG. 5 is a sectional view of an alternative embodiment of the invention attached to the ridge of a roof.

An alternative embodiment of the invention is illustrated in FIG. 5. In the corrugated roof vent with end cap 30 of FIG. 5 the strips (not shown) of corrugated layers 34 removed are wider than strip 13 of end cap 22 such that resulting flaps 32 may be folded completely around and under layers 34 (see FIG. 5). The end flap 32 is then secured in position by one of the nails 36 used to connect the end cap 30 to the roof structure 2.

It should be understood that the invention is not to be limited to the precise formed or method disclosed but may be modified within the scope of the appended claims.

I claim:

1. A corrugated roof vent for the ridge of a roof, said roof vent including a first corrugated sheet having an end edge and side edges, a plurality of second corrugated sheets having an end edge and side edges connected to said first corrugated sheet in underlying relationship adjacent one of said first corrugated sheet side edges, a plurality of third corrugated sheets having an end edge and side edges connected to said first corrugated sheet in underlying relationship adjacent another of said first corrugated sheet side edges, said plurality of second and third corrugated sheets being spaced from one another, said first corrugated sheet end edge including a flap overlying the end edges of said plurality of second and third corrugated sheets, said flap constituting means integral with said first corrugated sheet for preventing ingress through the said end edges of said plurality of second and third corrugated sheets.

2. The corrugated roof vent of claim 1 wherein said flap further overlies a portion of said plurality of second and third corrugated sheets.

3. A method of making a corrugated roof vent with an end cap including the steps of:

a. providing a corrugated roof vent having a first corrugated sheet, a plurality of second corrugated sheets being connected to said first corrugated sheet such that a side edge and an end edge of said plurality second corrugated sheets align with a side edge and an end edge of said first corrugated sheet, a plurality of third corrugated sheets connected to said first corrugated sheet spaced from said plurality of second corrugated sheets such that a side edge and an end edge of said plurality of third corrugated sheets align with a side edge and said end edge of said first corrugated sheet;

b. exposing a portion of said first corrugated sheet adjacent its said end edge by removing a strip of each of said plurality of second and third corrugated sheets, said end edges of said plurality of second and third corrugated sheets being recessed relative to said first corrugated sheet end edge after removal of said strips;

c. folding said exposed portion of said first corrugated sheet to overly the recessed end edges of said plurality of second and third corrugated sheets; and d. securing said exposed portion in the overlying relationship.

4. The method of claim 3 wherein step c includes the steps of:

a. scoring a line along said plurality of second and third corrugated sheets to define strips of said plurality of second and third corrugated sheets adjacent their said end edges;

b. cutting along the scored line;

c. removing said strips of said plurality of second and third corrugated sheets.

5. The method of claim 3 further including the steps of:

e. folding a remaining portion of said exposed portion over a portion of plurality of said second and third sheets in overlying relationship.

* * * * *